United States Patent [19]

Wolford et al.

[11] Patent Number: 4,844,701

[45] Date of Patent: Jul. 4, 1989

[54] MOBILE PUMP APPARATUS

[75] Inventors: Dale E. Wolford, Ashland; Frank D. Makowski, Mansfield; Mark L. Campbell, Shiloh; Michael T. Austen, Shelby, all of Ohio

[73] Assignee: The Gorman-Rupp Company, Mansfield, Ohio

[21] Appl. No.: 127,810

[22] Filed: Dec. 2, 1987

[51] Int. Cl.[4] ..... F04B 21/00

[52] U.S. Cl. ..... 417/234; 417/312

[58] Field of Search ..... 417/312, 313, 234; 181/202, 204, 203

[56] References Cited

U.S. PATENT DOCUMENTS

| | | | |
|---|---|---|---|
| 1,938,801 | 12/1983 | Bourne et al. . | |
| 2,886,721 | 5/1959 | Picozzi et al. . | |
| 3,478,958 | 11/1969 | Hinck, III et al. | 417/312 X |
| 3,642,092 | 2/1972 | Cederbaum | 181/204 |
| 3,856,439 | 12/1974 | Moehrbach | 417/312 |
| 3,960,238 | 6/1976 | McClure et al. | 181/204 |
| 4,022,550 | 5/1977 | Brink et al. | 417/312 X |
| 4,071,009 | 1/1978 | Kraina | 181/204 X |
| 4,302,160 | 11/1981 | Hofmann, Jr. | 417/313 |
| 4,382,481 | 5/1983 | Moore . | |
| 4,385,678 | 5/1983 | Cederbraum | 181/204 |

OTHER PUBLICATIONS

Advertisement for Le Roi 375 CFM Portable Compressor.

Advertisement for a Portable Generator sold by MQ Power Corp.

Descriptive article covering various portable compressor available from Le Roi Division of Dresser Industries.

*Primary Examiner*—Leonard E. Smith

*Attorney, Agent, or Firm*—Watts, Hoffmann, Fisher & Heinke Co.

[57] ABSTRACT

A mobile pumping unit including a housing enclosing an engine driven pump. The housing defines an air inlet chamber substantially isolated from an engine compartment. Air drawn into the inlet chamber by an engine driven blower is conveyed along a flow path and absorbs waste heat from the engine and is discharged to the ambient from an exit chamber. The inlet and exit chambers each include acoustic material for controlling noise in the air flow path. A conventional exhaust silencer is disposed in the exit chamber so that noise radiated from its surfaces is also controlled. A ventilation flow path for the engine compartment is established by bleeding off a portion of said cooling air and discharging it through a secondary outlet formed in the housing. A hot air outlet for the cooling air is formed by a self-opening door hingedly mounted to the housing which is automatically opened by the air pressure in the exit chamber when the pump unit is started. The door is operatively connected to an exhaust pipe cover.

17 Claims, 8 Drawing Sheets

146
146b
146a
320a
320
320b
312a
316a
316
322
324
312
314
310
122a 220
320b'
320'
94
320a'
324'
340
180
222a

MOBILE PUMP APPARATUS

TECHNICAL FIELD

The present invention relates to methods apparatus for controlling noise and in particular to a method and apparatus for controlling noise in a portable, engine driven pump unit.

BACKGROUND ART

There is a recognized need for a mobile, self-contained pump system to be used in various applications. The military uses portable pumps to pump water (and/or fuel) from a source to a remote location where military personnel are located. In some military applications, a series of pump units spaced miles apart are used to transfer water from a source of fresh water such as a lake to a location hundreds of miles inland. Civilian applications of portable pump units include emergency pumping of flood waters from a flooded location and the temporary pumping or transfer of sewage between transfer stations when the stationary pump units are inoperative. Portable engine driven air compressors are also used in many applications. Both engine driven liquid pumps and engine driven air compressors share a common problem - both are usually extremely noisy in operation. The noise generated by these portable units is often found to be highly objectionable in residential areas. In addition, the pump operators find working around, and operating these units, to be very uncomfortable and fatiguing due to the high noise level.

In the past, efforts have been made to quiet portable, engine driven air compressors. Completely shrouding or enclosing the machinery is not possible since many of the components, i.e. engine, require cooling air to remove waste heat. In the case of engine driven compressors, muffling the exhaust of the engine does not usually provide sufficient quieting since the engine driven compressor is also a substantial source of noise. In addition, the engine itself radiates noise from its surfaces.

Disclosure of the Invention

The present invention provides a new and improved mobile pumping apparatus including an engine driven fluid pump. The disclosed pumping unit includes noise and heat control structure which reduces the noise radiated from the engine/pump unit while at the same time ensuring adequate removal of waste heat.

According to the invention, the mobile pumping unit includes a housing that substantially encloses the engine and the engine driven fluid pump. In the disclosed and illustrated embodiment, the engine is air cooled and the pump is of the centrifugal type. The invention, however, is adaptable to other engine/pump configurations and types. Acoustical damping material is used on the inside of the housing in order to absorb sound generated by the engine and pump.

The housing also includes structure defining an air flow path for controlling the movement of cooling air through the housing and includes structure for acoustically treating the air flowing along the flow path so that cooling air discharged by the housing is not itself a source of noise.

According to a feature of the invention, both noise and heat dissipation are controlled in the air flowing through the housing. According to this feature, ambient air is drawn into the housing through a port which opens underneath the housing. The port communicates with an inlet chamber preferably having an acoustic baffle which forces the incoming air to travel in a circuitous path preferably including a 180° change in direction. A blower, preferably engine driven, provides the motive force for drawing ambient air into the inlet chamber. From the inlet chamber, the blower forces air along a flow path that includes passing the air across engine cooling structure, (such as heat exchange surfaces or fins) from which the cooling air absorbs waste heat. The air then enters an outlet passage which includes sound absorbing material.

In the preferred and illustrated embodiment, the outlet chamber surrounds an exhaust silencer for reducing the exhaust noise of the engine. By locating the muffler in the outlet passage, noise radiated from the exterior surface of the muffler as well as heat given off by the muffler casing are both controlled. The cooling air is then discharged to the ambient through a hot air outlet defined by the pump unit enclosure.

According to another feature of the invention, the hot air outlet in the enclosure includes a door that automatically opens whenever the pumping unit is put into operation. In addition, the door is interconnected with an exhaust pipe cap which also automatically opens the exhaust outlet for the engine whenever the engine is started. As a result, the enclosure is substantially sealed when not in operation and the entry of rain, snow etc. is inhibited when the unit is not in use.

Additional features of the invention will become apparent and a fuller understanding obtained by reading the following detailed description made in connection with the accompanying drawings.

BEST MODE FOR CARRYING OUT INVENTION

Figure 1:
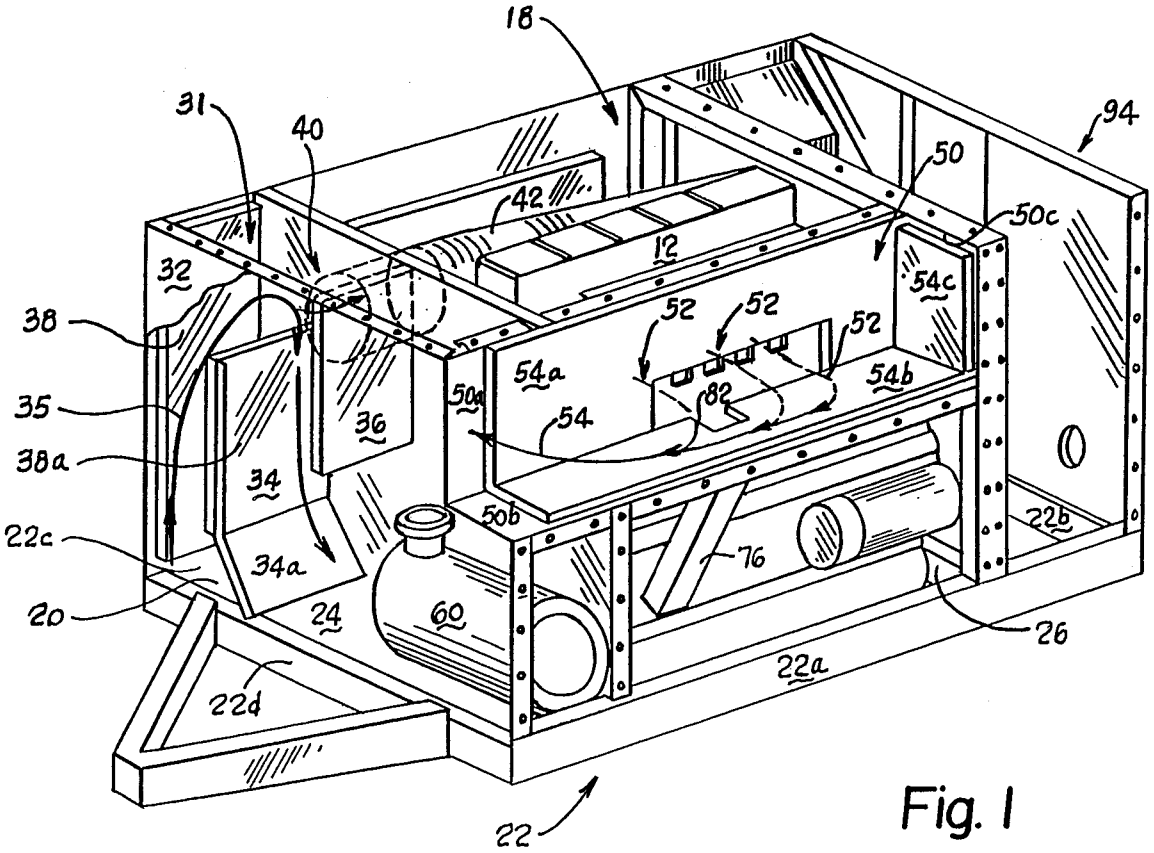
FIG. 1 is a perspective view, with portions shown schematically, of a portion of a mobile pumping system embodying the present invention, with covers removed and certain parts omitted, to show interior detail.

FIGS. 1–6 illustrate the overall construction of a mobile pumping system constructed in accordance with the preferred embodiment of the invention. The pumping system includes a housing 10 (to be described) that encloses a fluid pump 14 (shown in FIG. 3) preferably driven by an air cooled internal combustion engine 12 (shown best in FIGS. 2 and 3). In accordance with the invention, the housing establishes a flow path of cooling air which is drawn from the ambient through an inlet port 20 and is directed across heat exchange surfaces on the engine 12 in order to absorb waste heat. The cooling air is then exhausted to the ambient. The flow path defined by the housing acoustically treats the cooling air in order to minimize radiated and transmitted noise from the machinery contained within the housing.

In the preferred embodiment, the flow path of cooling air is substantially isolated from the interior of the housing and in particular, is isolated from an engine/-pump compartment indicated generally by the reference character 18. In the preferred embodiment, the compartment 18 is separately ventilated. To facilitate the explanation, various walls (internal and external) of the housing are indicated in phantom in FIGS. 2–6.

Figure 2:
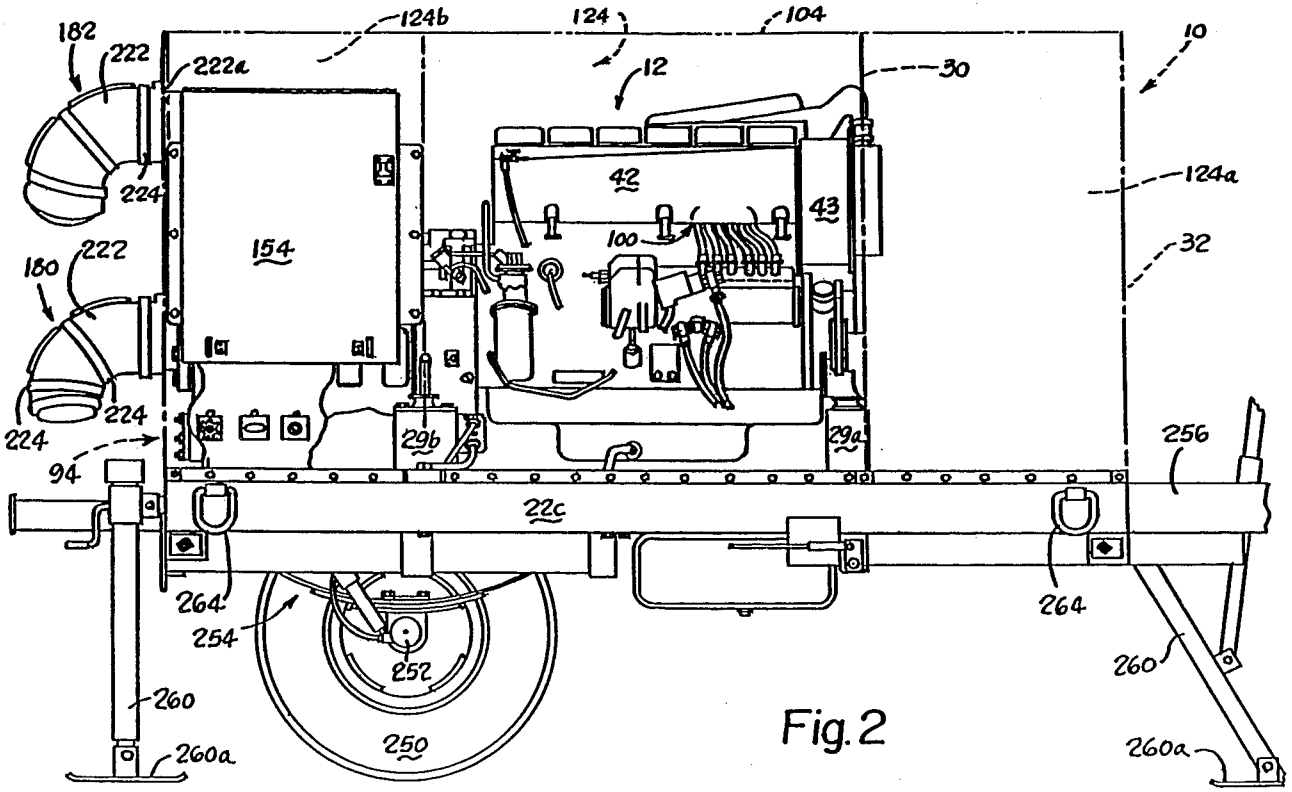
FIG. 2 is a side elevational view of the mobile pumping system with exterior and interior housing walls shown in phantom.

Referring to both FIGS. 1 and 2, the housing 10 of the mobile pumping system includes a lower frame structure indicated generally by the reference character 22 which includes perimeter frame members 22*a–d*. A substantially continuous floor pan 24 extends between the lower frame members; the floor pan 24 includes an opening in the upper left corner (as viewed in FIG. 1) which defines the inlet port 20 through which the cooling air is drawn. Two transverse cross members 26 (only one is shown in FIG. 1) extend between the frame member 22*a*, 22*c*. These support members provide mounting points for the engine 12 and the fluid pump 14 (seen best in FIGS. 2 and 3). In particular, engine and pump mounts 29*a*, 29*b* respectively, are attached to the cross members.

As seen in FIG. 1, the housing 10 includes an engine/-pump compartment bulkhead 30 which defines an air inlet chamber 31 between itself and an exterior front panel 32 (and portions of exterior side panels to be described). A baffle 34 including an angle portion 34*a* extends between the bulkhead 30 and the exterior panel 32. A secondary baffle 36 spaced from the first baffle is also located between the walls 30, 32. As indicated by the arrows 35 in FIG. 1, cooling air is drawn through the inlet port 20 and is forced to flow around the baffle 34 and the secondary baffle 36.

According to the invention, the inlet chamber 31 is lined with acoustic material as at 38. The baffles 34, 36 are also preferably covered with acoustic material 38*a*. The engine bulkhead 30 includes an aperture 40 which preferably communicates with a cooling air chamber 42 defined, in part, by a cowling that forms part of the air cooled engine 12. As is conventional, an engine driven blower 43 (shown in FIG. 4) is mounted in or near the engine cooling chamber 41 and draws cooling air through the aperture 40 and forces it across conventional heat exchange surfaces (not shown) forming part of the cylinder head and/or cylinder block. The cooling air moves across the heat exchange surfaces and is discharged into an exit chamber indicated generally by the reference character 50. The exit chamber 50 is defined, in part, by a vertical interior wall 50*a*, a transverse wall 50*b* and an interior end wall 50*c*. The flow path of the cooling air is indicated by the arrows 52.

The cooling air then flows through a discharge port (to be described) forming part of the housing 10 along a flow path indicated by the arrow 54. In the preferred embodiment, the exit chamber 50 is also lined with an acoustic material such as acoustic panels 54*a*, 54*b*, 54*c*.

The air inlet chamber 31 also provides a source of combustion air for the engine 12. In particular, a conventional air cleaner 60 is mounted within the chamber 31 and communicates with an intake air inlet 64 forming part of the engine 12 by way of a conduit 62 which extends through the bulkhead 30 (shown best in FIG. 3). By locating the air cleaner within the chamber 31, noise generated by combustion air being drawn into the engine is also acoustically treated.

Figure 3:
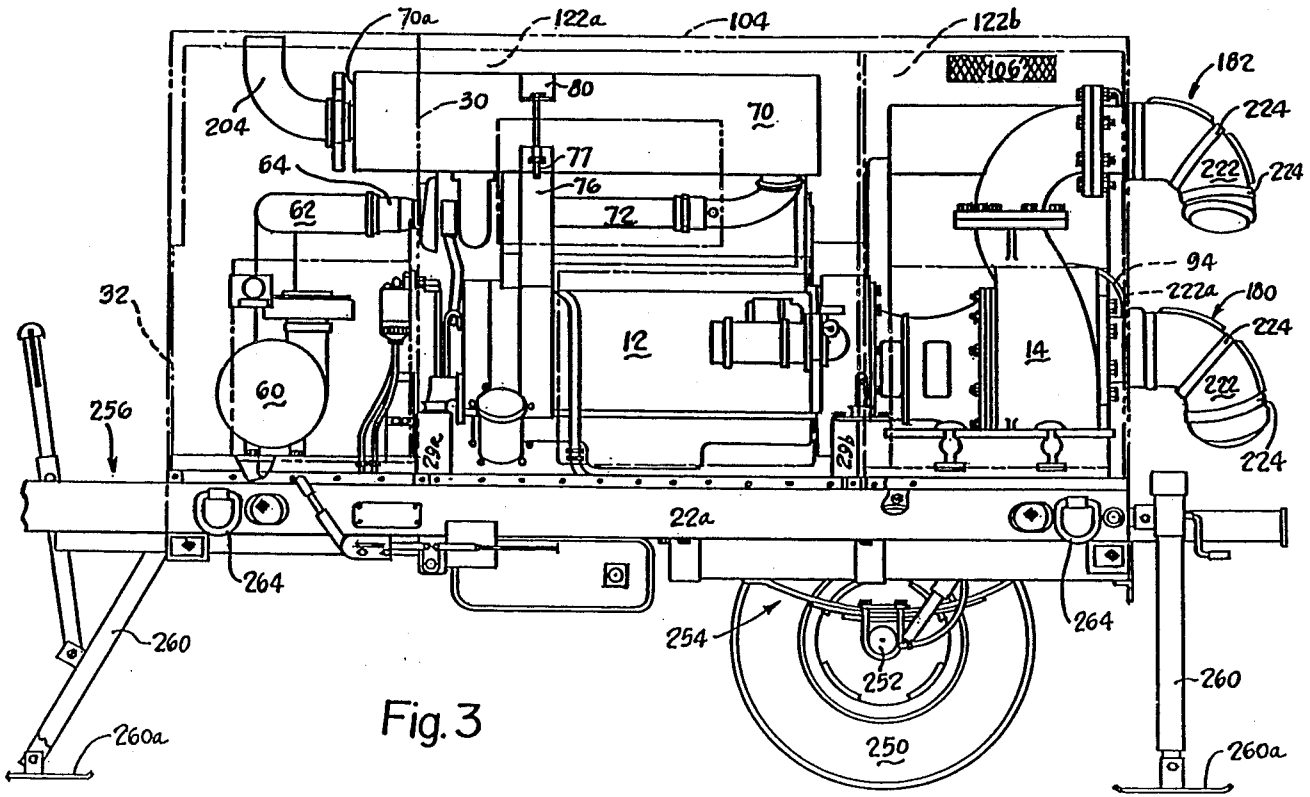
FIG. 3 is another side elevational view of the mobile pumping system with exterior and interior housing walls shown in phantom.
Figure 4:
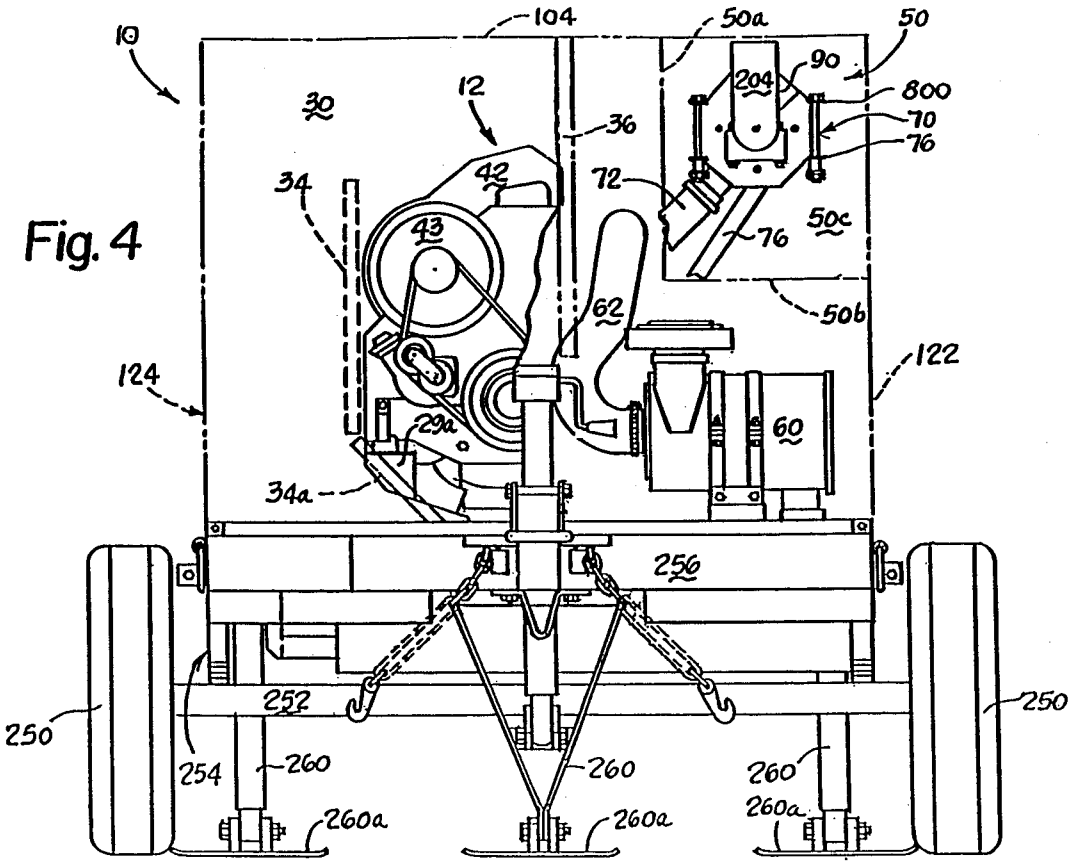
FIGS. 4 and 5 are opposite end views of the pumping system with housing walls shown in phantom.
Figure 5:
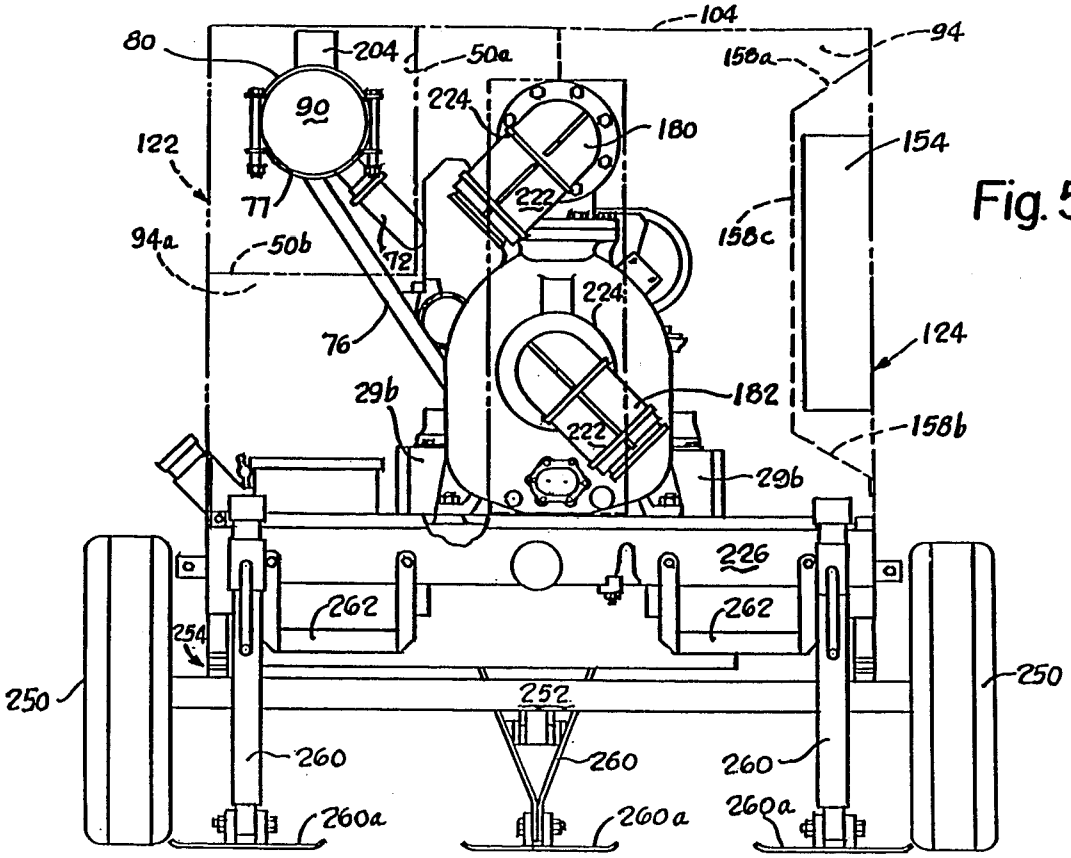

Referring also to FIGS. 3–5, a conventional exhaust silencer 70 is connected to an engine exhaust pipe 72 through which exhaust gases from the engine are discharged. According to a feature of the invention, the exhaust silencer 70 is supported within the exit chamber 50. Support for the exhaust silencer is provided by a strut 76 which is attached to the engine block and extends upwardly terminating in a saddle 77 to which the exhaust silencer 70 is held by a clamp 80. With this mounting, the exhaust silencer is rigidly connected to and moves with the engine 12. In order to accommodate relative motion between the engine 12 and the housing 10, the strut 76 extends through an opening 82 (see FIGS. 1 and 6) formed in the bottom wall 50*b* of the exit chamber 50. Resilient, flexible flaps are mounted in the opening 82 to form a somewhat sealing engagement between the strut 76 and the exit chamber 50 to inhibit or reduce air leakage.

In order to further reduce noise generated by the engine exhaust, acoustic material indicated by the reference character 90 (see FIG. 4) is secured to end 70*a* (see FIG. 3) of the exhaust silencer 70.

Figure 6:
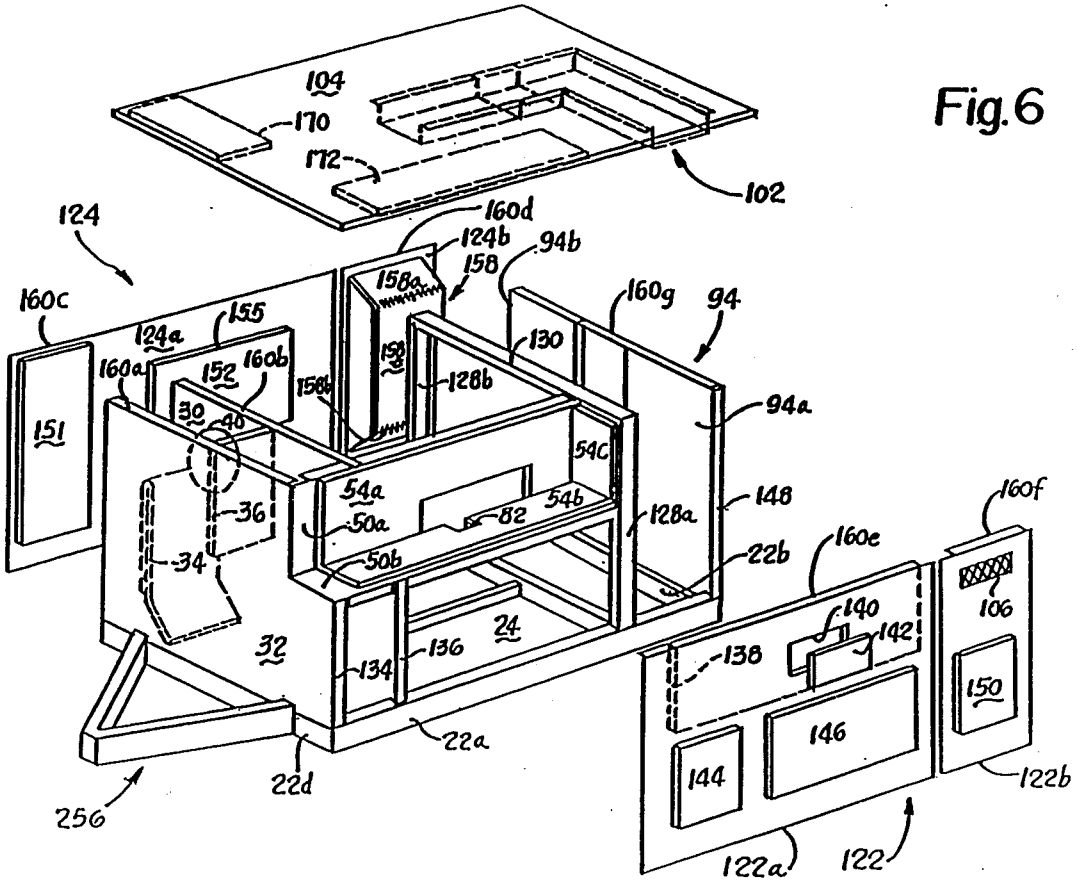
FIG. 6 is an exploded view of the housing of the mobile pumping system.

Referring in particular to FIGS. 1 and 6, the engine/-pump compartment 18 is defined between the engine bulkhead 30 and a rear panel, indicated generally by the reference character 94. As indicated above, the compartment 18 is substantially isolated from the cooling air flow path. Since heat is generated within the compartment 18 during pump use, according to the invention, a supplementary ventilation flow path is provided. In particular, a portion of the cooling air drawn into the engine coolant chamber 42 is bled into the engine/pump compartment 18 through a discharge channel indicated by the reference character 100 (shown in FIG. 2). In the preferred embodiment, this air is used to cool an oil heat exchanger (not shown) forming part of the engine. After passing through the oil heat exchanger, the air is discharged into the engine compartment 18 and ultimately exits the compartment 18 through duct work 102 mounted to a top cover panel 104 (shown best in FIG. 6). The duct 102 discharges the ventilation air from the engine compartment 18 to the ambient through a secondary hot air outlet 106 formed in a side panel (to be described) of the housing 10.

Turning to FIG. 6, further details of the housing 10 will be described. The exterior of the housing 10 is defined by the front exterior panel 32, the top cover 104, pairs of side panels indicated generally by the reference characters 122, 124, respectively, and the rear panel 94. A pair of vertical supports 128*a*, 128*b* extend upwardly from the base frame members 22*a*, 22*c*, respectively. A transverse, removable cross member 130 extends between, and is interconnected with, the upper ends of the vertical supports 128*a*, 128*b*. The upper cross member 130 is removable to facilitate lifting-/removing of the engine/pump unit (after the top cover 104 is removed).

The side panel pair 122 includes two individual panels 122*a*, 122*b*. The panel 122*a* is bolted to mounting surfaces 134, 136 defined by edges of the front panel 32 and the bulkhead 30. The rightmost edge (as viewed in FIG. 6) of the panel 122*a* is bolted to the vertical upright 128*a*. When the side panel 122*a* is mounted, it forms the outermost wall of the exit chamber 50. An acoustic panel 138 is mounted to the inside of the side panel 124*a*. An access opening 140 is provided by which access to the exit chamber 50 is provided. A door 142 including acoustic material on an inside surface closes off the opening during use. The side panel 124 also mounts a door 144 for providing access to the air cleaner and a larger, hinged door 146 providing access to the engine compartment. As will described in detail further on, both doors include accoustic material on their inside surfaces to control noise and sealing gaskets around their perimeters to minimize or eliminate air leakage out of the housing.

The side panel member 122*b* is fastened to the vertical cross member 128*a* and to a mounting surface 148 defined along an edge of the rear panel 94. The side panel 122*b* defines an access door 150 for providing access to the pump and also defines the secondary ventilation outlet 106 through which ventilation air from the engine compartment is discharged.

The side panel pair 124 includes side panel members 124*a*, 124*b*. The panel member 124*a* like the panel member 122*a* is fastened to the vertical support member 128*b* and a mounting surface defined by an edge of the exterior panel 32. An acoustic panel 151 is fastened to the inside of the member 124*a* that is located within the inlet chamber 31. The panel 124*a* also includes a door 155 for providing access to the engine compartment 18 that includes an acoustic panel 152.

The side panel member 124*b* defines an inwardly extending instrument panel housing 158. Referring also to FIG. 2, the instrument panel 154 is mounted within a recess defined by the housing 158 but is spaced from upper and lower housing walls 158*a*, 158*b* and a rear wall 158*c*. With this construction, an air space is defined between back of the instrument panel 154 and the recess defined by the housing 158 which serves to isolate the instrument panel 154 from heat radiated from the engine compartment.

The top cover 104 is sealing fastened to mounting surfaces defined by: upper edges 160*a*, 160*b*, 160*c*, 160*d*, 160*e*, 160*f*, 160*g* of the panels 32, 30, 122*a*, 122*b*, 124*a*, 124*b*, 94, respectively, and the cross member 130. Acoustic panels 170, 172 are appropriately positioned so that they will be located in the inlet chamber 31 and exit chamber 51 when the top cover 104 is mounted in position. The top cover also includes an exhaust port 174 (shown in FIG. 8) through which the engine exhaust is discharged.

The rear panel 94 is preferably comprised of two individual panel members 94*a*, 94*b*. With this construction, the two panel members can be removed in order to provide access to the pump 14 without the need for removing pump inlet and outlet elbows 180, 182, respectively (shown in FIG. 2).

Figure 8:
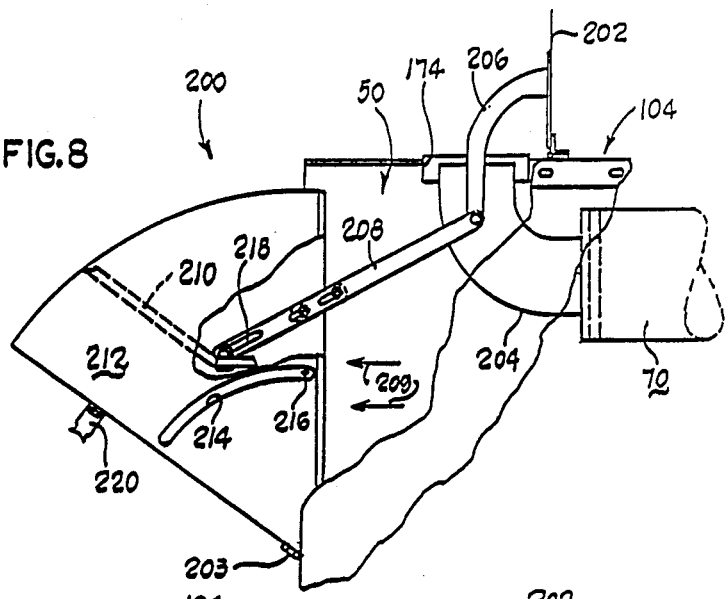
FIG. 8 is a fragmentary elevational view of the hot air discharge outlet.
Figure 7:
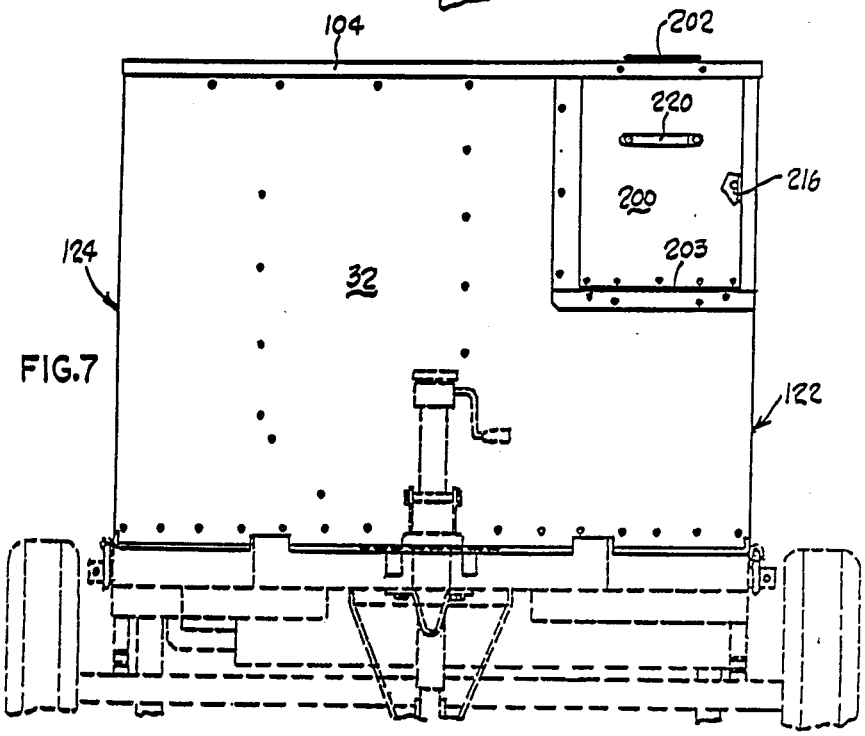
FIG. 7 is a front end view of the mobile pumping system showing a self opening hot air discharge outlet.

Turning now to FIGS. 7 and 8, the cooling air is exhausted to the ambient through a scoop-like outlet indicated generally by the reference character 200 in FIG. 8. The scoop 200 is hingedly mounted to the front panel 30 by a hinge 203. In the preferred embodiment, the air outlet scoop is operatively connected to an exhaust cover 202 which is operative to close off an outlet pipe 204 of the exhaust silencer when the system is not in use.

In the preferred embodiment, an arm 206, attached to the cover 202, is pulled to an open position by an operating lever 208 as the scoop 200 opens. With the preferred construction, the scoop 200 is automatically opened by the pressure of air in the exit chamber 50 applied against the interior of the door 200 (indicated by the arrows 209 in Figure as the pump system is started. In the preferred embodiment, a baffle 210 is positioned within the scoop-like door 200 and is preferably covered with acoustic material; at least portions of the inside surface of the door are also covered with acoustic material in order to reduce noise as the air exits the outlet. A side wall 212 of the door 200 defines a slot 214 which cooperates with a pin or bolt 216 to limit the outward movement of the door 200. The actuating lever 208 also includes a slot 218 which provides a lost motion connection between the exhaust pipe cover 202 and the door 200. A handle 220 is also provided for manually opening the door should it be necessary.

In order to further reduce radiated noise, the pump inlet and outlet elbows 180, 182 are covered with acoustic insulating jackets 222. In the preferred construction, each jacket 222 includes two rigid cover portions which are molded to conform to the shape of the elbow. Acoustic material is contained within the cover portions and is held against the associated elbow when the cover portions are clamped. A plurality of clamping bands 224 clamp the cover portions together and around the pump elbow. Gaskets are used to seal end surfaces 222*a* of the insulating jackets to the rear panel 94 to inhibit air and noise leakage from the engine/-pump chamber 18 through apertures formed in the rear panel 94 through which the elbows extend. The insulating jackets are easily removed from the pump elbows 180, 182 for servicing.

Figures 9, 10:
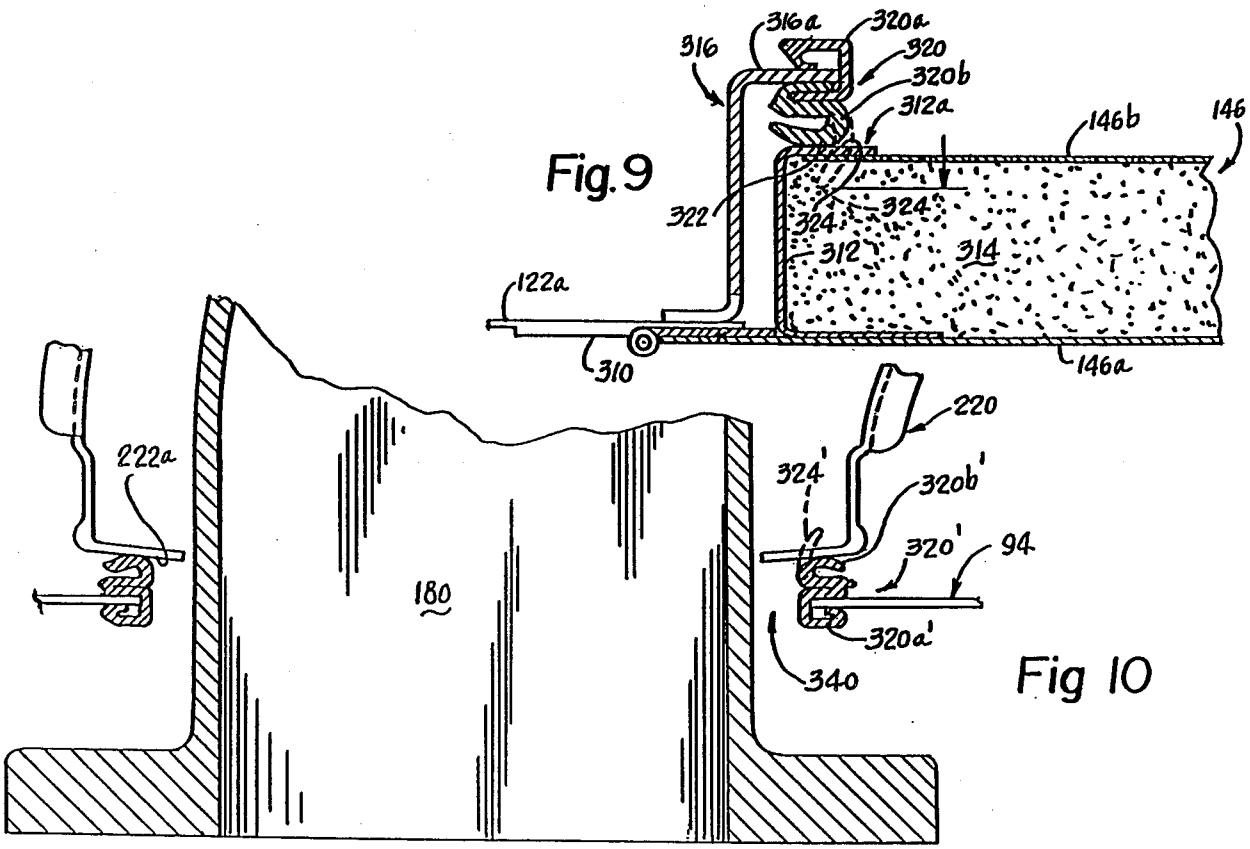
FIG. 9 is a fragmentary, sectional view of a door sealing arrangement.
FIG. 10 is fragmentary, sectional view of a gasketing arrangement for sealing a pump fitting to a housing.

A preferred gasketing arrangement for an access door is shown in FIG. 9. The disclosed arrangement is used for all hingedly mounted access doors forming part of the housing 10. For purposes of explanation, the arrangement shall be described in connection with the access door 146 (shown in FIG. 6) mounted to the side panel 122*a*. A hinge 310 for hingedly mounting the door 146 is suitably fastened to the panel 122*a* as by welding or riveting. The door 146 includes spaced apart outer and inner panels 146*a*, 146*b* interconnected by perimetrically located U-channels 312. The inner panel 142*b* is perforated. An acoustic foam material 314, captured between the panels 146*a*, 146*b*, is operative to absorb interior noise and inhibit its radiation from the housing 10. A seal support bracket 316 is fixed to the inside of the panel 122*a* (as by welding or riveting) and defines a seal support flange 316*a* spaced from and in confronting relation with an inside flange 312*a* defined by the U-shaped channel 312. The seal supporting bracket 316 is disposed along all four sides of the door 146. An elastomeric seal 320 including a U-shaped, flange engaging portion 320*a* is carried by the flange 316*a*. The seal also includes a longitudinally extending, curved sealing portion 320*b*. When the door 146 is closed, the curved portion 320*b* is bent inwardly from its relaxed position indicated in phantom by the reference character 324 to the position shown in solid line. An outer surface 322 of the curved seal portion tangentially engages a surface 324 of the U-shaped channel 312 forming part of the door 146 and hence provides a sealing interface inhibiting the discharge of air and noise between the door 146 and the side panel 122*a*.

A similar arrangement is used to seal the interface between the rear panel 94 and the inlet and outlet elbows 180, 182. In particular (and referring to FIG. 10) a similar seal 320' is mounted to the inside of an aperture indicated generally by the reference character 340 defined by the rear panel 94 (only one side of the aperture is shown) through which the inlet elbow 180 extends (the outlet elbow 182 extends through a similar aperture). When the associated noise control jacket 220 is mounted to the elbow 180, the end surface 222*a* abuts the curved portion 320*b'* of the seal 320' and seals the opening defined by the rear panel 94 (through which the elbow extends) inhibiting the passage of air and noise from inside the housing 10. It should be noted that with the disclosed arrangement, the gaskets do not inhibit the opening and closing of the doors or the removal and/or disassembly of the elbows from the pump unit. With the disclosed invention, substantially reduced sound levels can be realized in a mobile pump system without compromising reliability or serviceability.

The disclosed mobile pumping system includes a pair of pneumatic tires 250 rotatably supported by a conventional axle 252. The axle 252 is secured to a conventional leaf spring suspension system, indicated generally by the reference character 254. A V-shaped trailer hitch frame 256 is located at the front of the unit. After the pumping unit is positioned, jacks 260 including support pads 260*a* are lowered and support the unit during operation. The pumping unit also includes fork-lift brackets 262 mounted below the rear frame member 22*b* (see FIG. 5) which enable the pumping station to be lifted and transported by a conventional fork-lift or similar vehicle. Loops 264 are also provided on the frame members 22*a*, 22*c* (see FIG. 3) by which the unit can be attached to a lifting device or parachute.

Although the invention has been described with a certain degree of particularity, it should be understood that those skilled in the art can make various changes to it without departing from the spirit or scope of the invention as hereinafter claimed.

We claim:

1. A mobile pumping unit, comprising:

(a) a support platform;

(b) a fluid pump mounted to said platform;

(c) an internal combustion engine mounted to said platform and operatively connected to said fluid pump;

(d) enclosure walls surrounding said engine and fluid pump, together with said support platform defining a housing;

(e) said housing defining an interior portion in which said engine is located and an inlet through which cooling air is drawn into an inlet chamber, said inlet and outlet chamber being substantially isolated from said interior portion of said housing;

(f) structure defining a heat exchange flow path, substantially isolated from said interior portion of said housing, through which cooling air is passed in order to absorb waste heat from said engine;

(g) an exit chamber including noise control material, communicating with an output side of said heat exchange flow path, said exit chamber terminating in an outlet for discharging said cooling air into the ambient, and (h) an engine exhaust silencing device disposed in said exit chamber.

2. The apparatus of claim 1 further comprising a self opening exit door defining a discharge outlet for said cooling air.

3. The apparatus of claim 1 wherein a portion of said cooling air passing through an input side of said heat exchange flow path is diverted into the interior of said housing to provide ventilation therein and said housing includes a conduit and ventilation outlet for discharging said diverted air into the ambient.

4. The apparatus of claim 1 wherein said inlet chamber is defined by an isolated compartment within said housing including sound absorbing material for reducing radiated noise, said compartment including an engine inlet means through which combustion air is drawn into said engine.

5. A mobile pumping unit, comprising:

(a) a support frame for mounting an engine driven pumping unit;

(b) a housing mounted to said support frame and surrounding said engine and pump unit;

(c) said housing including a bulkhead for dividing said housing into an inlet chamber and an engine compartment, said inlet chamber and engine compartment being substantially isolated;

(d) said housing further defining a cooling air flow path extending from said inlet chamber to a hot air outlet;

(e) an exit chamber forming part of said cooling air flow path and operative to receive and collect cooling air after it has passed through a heat exchange region forming part of said engine;

(f) a ventilation flow path defined by said housing including means for bleeding off a portion of said cooling air and directing it through said engine compartment;

(g) said housing further defining a secondary hot air outlet through which said ventilation air is discharged.

6. The apparatus of claim 5 further comprising an exhaust silencer disposed in said exit chamber.

7. The apparatus of claim 5 further comprising a self-opening door forming part of said exit chamber which is opened by air pressure developed in said exit chamber when the pumping unit is started.

8. The apparatus of claim 7 wherein said self-opening door is scoop-like in configuration and is hingedly attached to a panel of said housing.

9. The apparatus of claim 8 further comprising a cover plate for covering an exhaust port of said engine including operating means operatively connected to said door such that said exhaust port cover is opened when said door is opened by the air pressure in said exit chamber.

10. The apparatus of claim 8 wherein said exhaust silencer is supported by a strut extending between the silencer and said engine such that said exhaust silencer and engine move in unison and said flow path includes sealing means for inhibiting air leakage between said strut and said exit chamber.

11. The apparatus of claim 5 wherein said cooling air is drawn into said inlet chamber by an engine driven blower.

12. The apparatus of claim 5 wherein said engine is air cooled and includes heat exchange surfaces for transferring waste heat from said engine to said cooling air.

13. The apparatus of claim 5 further comprising at least one hingedly mounted access door and a gasket for sealing an interface between said door and said housing, said seal having a longitudinally extending, curved portion that tangentially engages a sealing surface defined by said door.

14. The apparatus of claim 5 further comprising at least one hingedly mounted access door and a gasket for sealing an interface between said door and said housing, said seal having a longitudinally extending, curved portion that tangentially engages a sealing surface defined by said housing.

15. The apparatus of claim 5 wherein said housing defines at least one aperture through which a pump fitting extends and said apparatus includes a seal having a curved portion that tangentially engages said fitting and seals an interface between said fitting and said housing whereby air leakage from an interior of said housing is inhibited.

16. The apparatus of claim 15 further comprising a removable insulating jacket surrounding said fitting and defining an end surface engaged by said seal.

17. A mobile pumping unit, comprising:

(a) a support platform;

(b) a fluid pump mounted to said platform;

(c) an internal combustion engine mounted to said platform and operatively connected to said fluid pump;

(d) enclosure walls surrounding said engine and fluid pump, together with said support platform defining a housing;

(e) said housing defining an inlet through which cooling air is drawn into an inlet chamber;

(f) structure defining a heat exchange flow path through which cooling air is passed in order to absorb waste heat from said engine;

(g) an exit chamber including noise control material, communicating with an output side of said heat exchange flow path, said exit chamber terminating in an outlet for discharging said cooling air into the ambient;

(h) an engine exhaust silencing device disposed in said exit chamber; and, (i) means for diverting a portion of said cooling air passing through an input side of said heat exchange flow path into an interior portion of said housing to provide ventilation therein and said housing includes a conduit and ventilation outlet for discharging said diverted air into the ambient.

* * * * *